United States Patent [19]

Ewing

[11] Patent Number: 4,878,831

[45] Date of Patent: Nov. 7, 1989

[54] INFRARED FLAME DETECTOR ADAPTABLE FOR DIFFERENT FUELS

[75] Inventor: Donald L. Ewing, Richardson, Tex.

[73] Assignee: Forney International, Inc., Carrollton, Tex.

[21] Appl. No.: 261,335

[22] Filed: Oct. 24, 1988

[51] Int. Cl.[4] ..... F23N 5/08

[52] U.S. Cl. ..... 431/79; 250/339; 340/578

[58] Field of Search ..... 431/12, 79; 340/577, 340/578; 250/339

[56] References Cited

U.S. PATENT DOCUMENTS

| | | | |
|---|---|---|---|
| 3,026,927 | 3/1962 | Matheis et al. | 431/79 |
| 3,902,841 | 9/1975 | Horn | 250/338 X |
| 4,477,245 | 10/1984 | Giachino et al. | 431/79 X |

*Primary Examiner*—Randall L. Green

*Attorney, Agent, or Firm*—Lane and Aitken

[57] ABSTRACT

In an infrared flame detector system an infrared photodetector is positioned to receive infrared radiation from the flame to be detected. The output of the infrared flame detector is amplified with a gain readily switchable between two different gain values. The amplified output signal is filtered by a programmable high pass filter, in which the corner frequency can be selected to have different values and is readily switchable between two different values to correspond with different fuels generating the flame being detected. The output of the programmable filter is full wave rectified to provide a DC signal level corresponding to the AC signal generated across the photodetector. This DC signal level is compared with a reference signal voltage selected to correspond with the signal voltage produced when no flame is present, to provide an indication of the presence or absence of a flame.

8 Claims, 3 Drawing Sheets

INFRARED FLAME DETECTOR ADAPTABLE FOR DIFFERENT FUELS

This invention relates to infrared flame detector systems for monitoring fossil fuel fired furnaces and controlling the flow to the selected burners in accordance with the detected flame. For example, in the case of flame failure, it is desirable that such failure be indicated, an alarm be operated, and fuel flow stop to the burner at which the flame failure occurred to avoid flooding and possible explosion in the furnace.

In U.S. Pat. No. 3,902,841 to Robert Horn issued Sept. 2, 1975 and assigned to the assignee of this applicaton discloses an infrared flame detection system. The above system in the above mentioned patent is described as being applicable to coal, gas and oil fired burners and comprises an infrared photodetector mounted in a housing with a preamplifier. The housing is mounted in the wall of the furnace positioning the infrared photodetector to receive radiation from the burner flame. The output from the preamplifier which amplifies the output from the infrared photodetector is then further amplified, filtered and rectified in a half wave rectifier to provide an output signal indicating the presence or absence of a flame at the burner. The above described system is an effective unit for detecting the presence and absence of a flame at a given burner. However, some furnaces can be converted to use different fuels and the flame which results from the different fuels have different characteristics. Thus, the amplification and filtering which is suitable for the flame provided from one fuel, often is not well designed to detect the flame generated by the alternate fuel. The present invention facilitates switching of the gain and filtering parameters to correspond to fuel being burned and also adjustment of these parameters to correspond to the characteristics of indivdual burners.

SUMMARY OF THE INVENTION

The present invention employs an infrared detector and a preamplifier mounted in a housing, which in turn is mounted in the furnace wall as in the system of the prior art. The preamplifier of the present invention improves over that of the prior art system in that it employs a thermistor to compensate the variation in the infrared photodetector output with different temperatures to which the unit will be subjected. The output from the preamplifier is amplified by a dual channel amplifier which is controllable to select either of two channels, each of which has a different gain selected to correspond to the flame from a different fuel which might be monitored by the flame detecting system. The output from the dual channel amplifier is filtered by a programmable filtering device, which is provided with a switching circuit to switch the programming filtering device between two different filtering characteristics, each corresponding to the flame from a different fuel. The output from the programmable filtering device is amplified by a full wave rectifier and the output from the rectifier is applied to indicators and meters to indicate the presence or absence of a flame.

DESCRIPTION OF A PREFERRED EMBODIMENT

Figure 1:
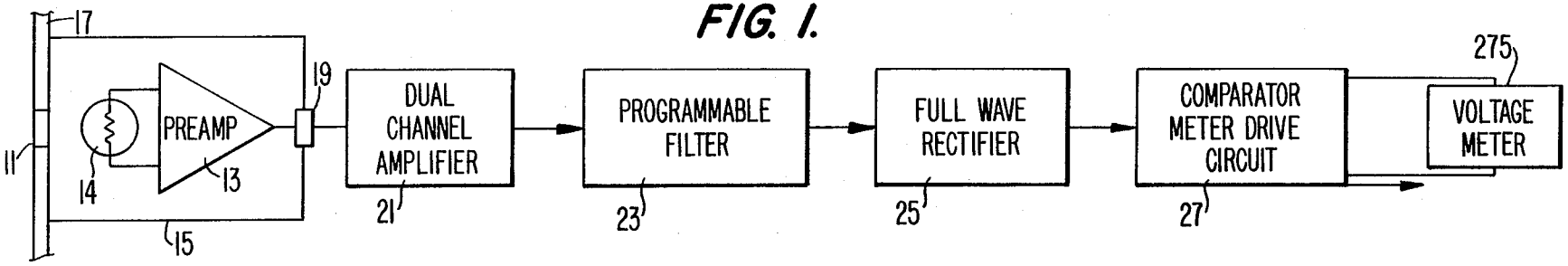
FIG. 1 is a block diagram illustrating the system of present invention.

As shown in FIG. 1, the system of the present invention comprises an infrared photodetector 11, the output of which is amplified by a preamplifier 13. The infrared photodetector 11 and the preamplifier 13 are mounted in a housing 15, which is mounted in the wall 17 of a furnace. The furnace contains the burner or burners, the flames of which the system is designed to monitor. The wall 17 has a window 19 defined in the wall 17 to permit infrared radiation to be received by the photodetector 11 through the window 19 from the burner flame.

The output from the preamplifier is connected through quick disconnect hardware 19 to the input of a dual channel amplifier stage 21, which may be located remotely from the housing 15. The preamplifier and the photodetector is a potted unit and is designed to be replaced as a unit as needed for maintenance of the system.

In the dual channel amplifier stage 21, two amplifier channels are provided each having independently controlled gains, which are adjusted individually to correspond to the fuels burned in the furnace. For example, a coal fired burner flame for optimum condition should have a higher amplifier gain than an oil fired flame. The dual channel amplifier stage 21 is provided with an input for selecting which amplification channel of the amplifier is to be used and apply its output signal to the output of the amplifier. Thus the gain in the amplifier 21 is readily selected to correspond with the fuel being burned in the furnace. The output from the amplifier 21 is applied to a programmable filter 23 operating in a high pass mode. The programmable filter can be controlled to have a corner frequency selected from different values ranging between 20 and 300 hertz. The corner frequency selected depends upon the fuel being burned as well as the characteristics of the individual burner itself. The programmable filter 23 is provided with a manually operated switch by which the frequency of the filter can be readily switched between two different corner frequencies to correspond with two different fuels which may be burned in the furnace. The output from the programmable filter is rectified by a full wave rectifier to generate a DC output signal corresponding to the flame intensity. This DC signal is subtracted from a reference signal in the comparitor and meter drive circuit 27 with the reference signal being selected to correspond with the background signal output from the full wave rectifier when no flame is present. The difference between these two signals is amplified by a differential amplifier to provide an output signal indicating the presence or absence of a flame. In addition, the difference between these two signals is measured by a current meter 28 to indicate the level of the signal indicating the presence of a flame.

Figure 2:
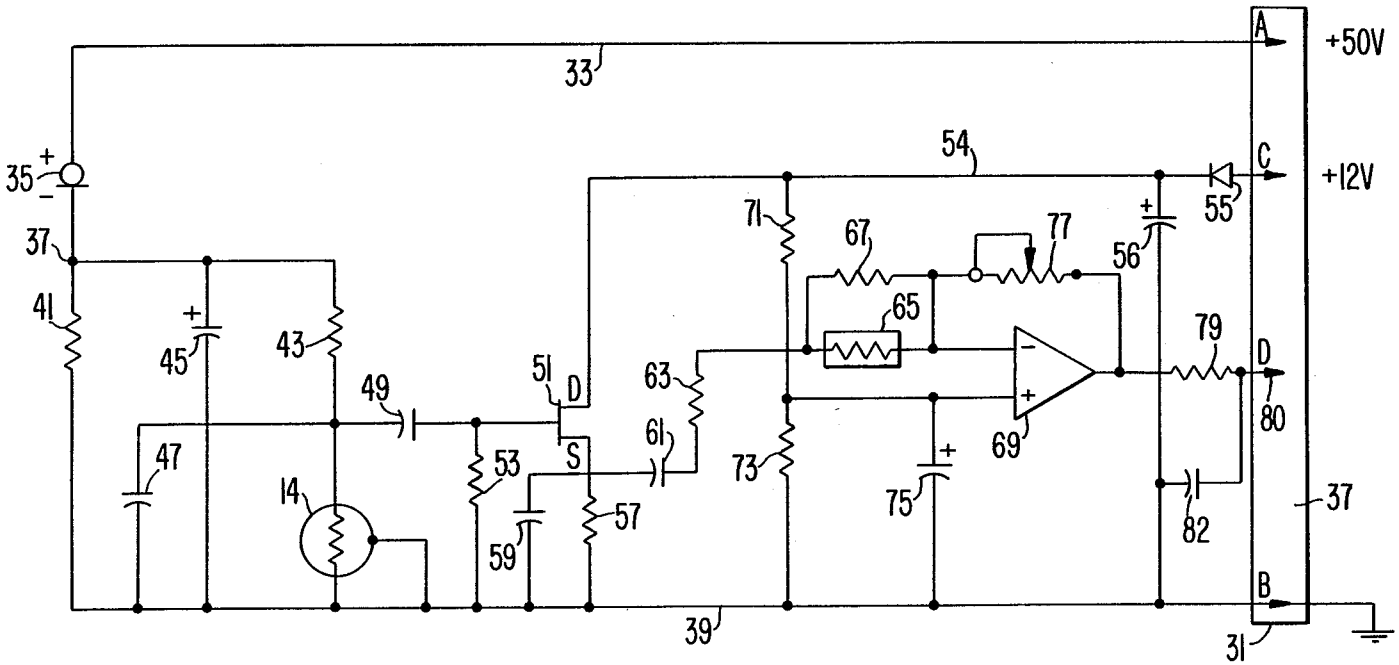
FIG. 2 is a circuit diagram of the preamplifier in combination with the infrared photodetector housed in the head mounted in the furnace wall.

As shown in FIG. 2, in the preamplifier circuit, a source of 50 volts is applied through the quick disconnect hardware 31 to a power line 33 which is connected through a constant current diode 35 to a junction 37. The junction 37 is connected to a ground lead 39 through a load resistor 41. The ground lead 39 is connected to ground through the quick disconnect hardware 31. The constant current diode 35 and the load resistor 41 provide a constant voltage at the junction 37. The infrared photodetector 14 is connected in a series with a 220 kilohm resistor 43 between the junction 37 and the ground lead 39 and with this arrangement generates an output signal voltage proportional to the received infrared radiation. The junction 37 is connected to ground through a 22 microfarad capacitor 45 to eliminate transients at the junction 37.

A 0.001 microfarad capacitor 47 is connected in parallel with the infrared photodetector 14 to protect the photodetector from high frequency transients. A 0.001 microfarad capacitor 49 connects the junction between the photodetector 14 and the resistor 43 to the gate of a field effect transistor 51. The capacitor 49 serves to remove the DC component from the output signal voltage produced at the junction between the photodetector 14 and the resistor 43 so that only the alternating signal component is applied to the gate of the field effect transistor 41. This alternating signal component is what indicates the presence or absence of a flame in the furnace. A 22 megohm resistor 53 connects the gate of the field effect transistor 51 to the ground lead 39. The drain of the field effect transistor 51 is connected to a positive DC source of 12 volts applied to a line 54 through the quick disconnect hardware 31 and an isolating diode 55. A 22 microfarad capacitor 56 connects the 12 volt line 54 to the ground lead 39 to remove high frequency transients from the line 54. The source of the field effect transistor 51 is connected through a 27 kilohm resistor 57 to the ground lead 39. The resistor 57 is shunted by a 0.0047 microfarad capacitor 59. With this circuitry, the AC signal generated across the photodetector and applied to the gate of the field effect transistor 51 will be amplified at the source of the transistor 51. This AC signal is applied through the series circuit of a 0.047 microfarad capacitor 61, a 1 kilohm resistor 63, and a thermistor 65 to the inverting input of an operational amplifier 69. The thermistor 65 is shunted by a 390 kilohm resistor 67. The thermistor 65 serves to compensate for variations in the AC signal produced across the photodetector 14 as a result of changes in temperature of the photodetector 14.

A voltage divider comprising a series circuit of 22 kilohm resistors 71 and 73 are connected between the 12 volts on the line 54 and the ground on the line 39. The junction between the resistors 71 and 73 is connected to apply plus 6 volts to the positive input of the operational amplifier 69. The resistor 73 is shunted by a 5.6 microfarad capacitor 75. The output from the amplifier 69 is connected back through a one megohm variable resistor 77 to the inverting input of the operational amplifier 69. With this arrangement, the AC signal applied at the inverting input of the amplifier 69 will be reproduced in inverted form at the output of the differential amplifier 69. This output signal is applied through a 100 ohm resister 79 and the disconnect hardware 31 to the output signal line 80 of the preamplifier. The output signal line of the preamplifier is also connected to the ground line 39 through a 0.047 microfarad capacitor 82 to protect the operational amplifier 69 from high frequency transients that might occur on the output signal line.

Figure 3A:
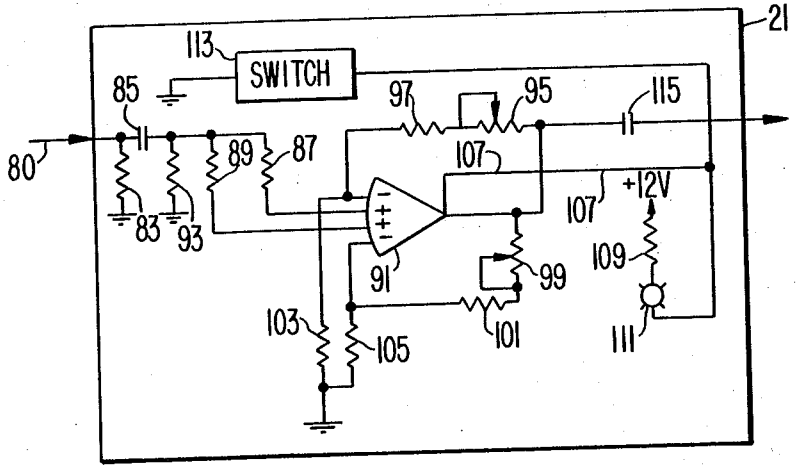
FIG. 3A is a diagram of the dual channel amplifier stage of the infrared detecting system receiving the output signal from the preamplifier shown in FIG. 2.

As shown in FIG. 3A, the signal line 80 is connected to the input of the dual channel amplifier stage 21, where the signal line 80 is connected to ground through a 1 kilohm load resister 83. A 1 microfarad capacitor 85 connected in a first series circuit with a 2 kilohm resistor 87 and in a second series circuit with a 2 kilohm resistor 89 to the plus inputs of both sides of dual channel differential amplifier 91. The junction between the capacitor 85 and the resistors 87 and 89 is connected to ground through a 100 kilohm resistor 93. The output of the dual channel amplifier 91 is connected through a 100 kilohm variable resistor 95 connected in series with a 1 kilohm resistor 97 to the minus input of one channel of the dual channel amplifier 91 to provide a variable gain to this channel. The output of the amplifier 91 is also connected through a 100 kilohm variable resistor 99 and a 1 kilohm resistor 101 to the minus input of the other channel of the dual channel amplifier 91 provide variable gain to this channel. The minus inputs of each channel of the amplifier 91 are connected through 4.12 kilohm resistors 103 and 105 to ground. The dual channel amplifier 91 will amplify the input signal in either selected channel and produce an amplified signal voltage applied at its output signal line. The channel selected depends upon the signal voltage applied on the input control line 107. If a ground voltage is applied to this control line, then one channel of the amplifier 91 will be selected to amplify the signal voltage applied to its input and if plus 12 volts is applied to this control line, the other channel of the amplifier 91 will be selected to amplify the signal voltage applied to its input. The gain of the upper channel is controlled by the variable resistor 95 by controlling the amount of feedback signal voltage applied to the minus input of this channel and the gain of the lower channel is controlled by the variable resistor 99 in a similar manner. Thus, by properly setting the variable resistors 95 and 99 and controlling the signal voltage on the control line 107, the gain with which the input signal is amplified by the dual amplifier change can readily be switched between one selected gain and another with each gain selected by the variable resistors 95 and 99 to correspond with the two different fuels which may be burned in the furnace.

Plus 12 volts is applied through a 4.12 kilohm resistor 109 and a signal lamp 111 to the control line 107 which is also connected through a remotely controlled switch 113 to ground. Depending on the condition of the switch, whether it is open or connects the control line 107 to ground, either 12 volts or ground will be applied to the control line 107 and thus, by means of the switch 113, the gain with which the input signal is amplified is readily switched between the two different values as selected by the variable resistors 95 and 99. The stage of signal lamp 111 indicates which channel has been selected.

Figure 3C:
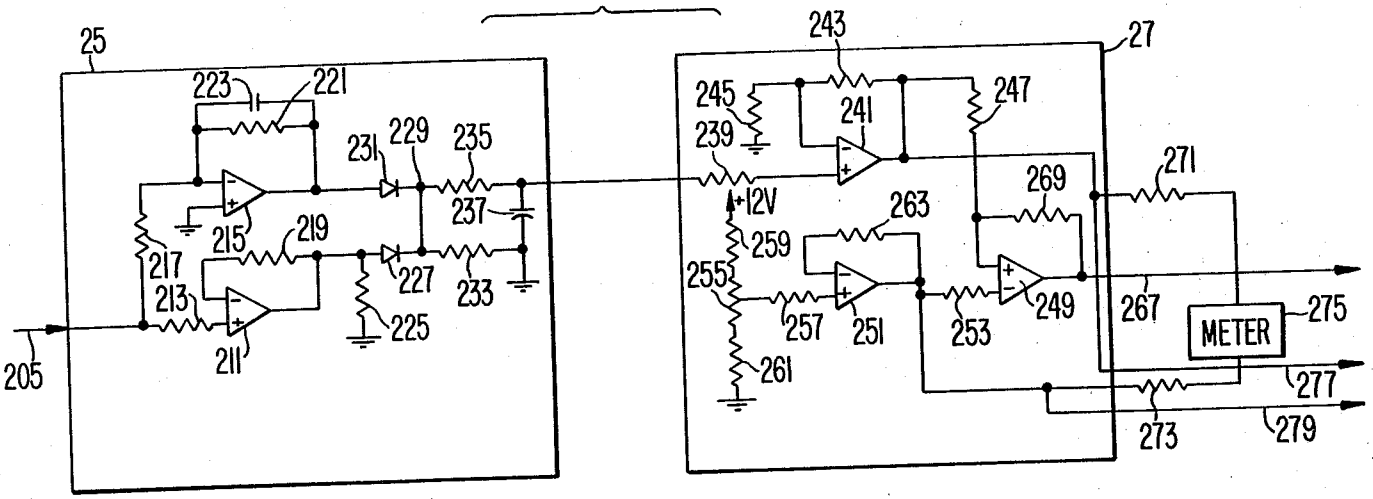
FIG. 3C is a circuit diagram of the full wave rectifier and comparitor and meter drive circuit of the system of the invention.
Figure 3B:
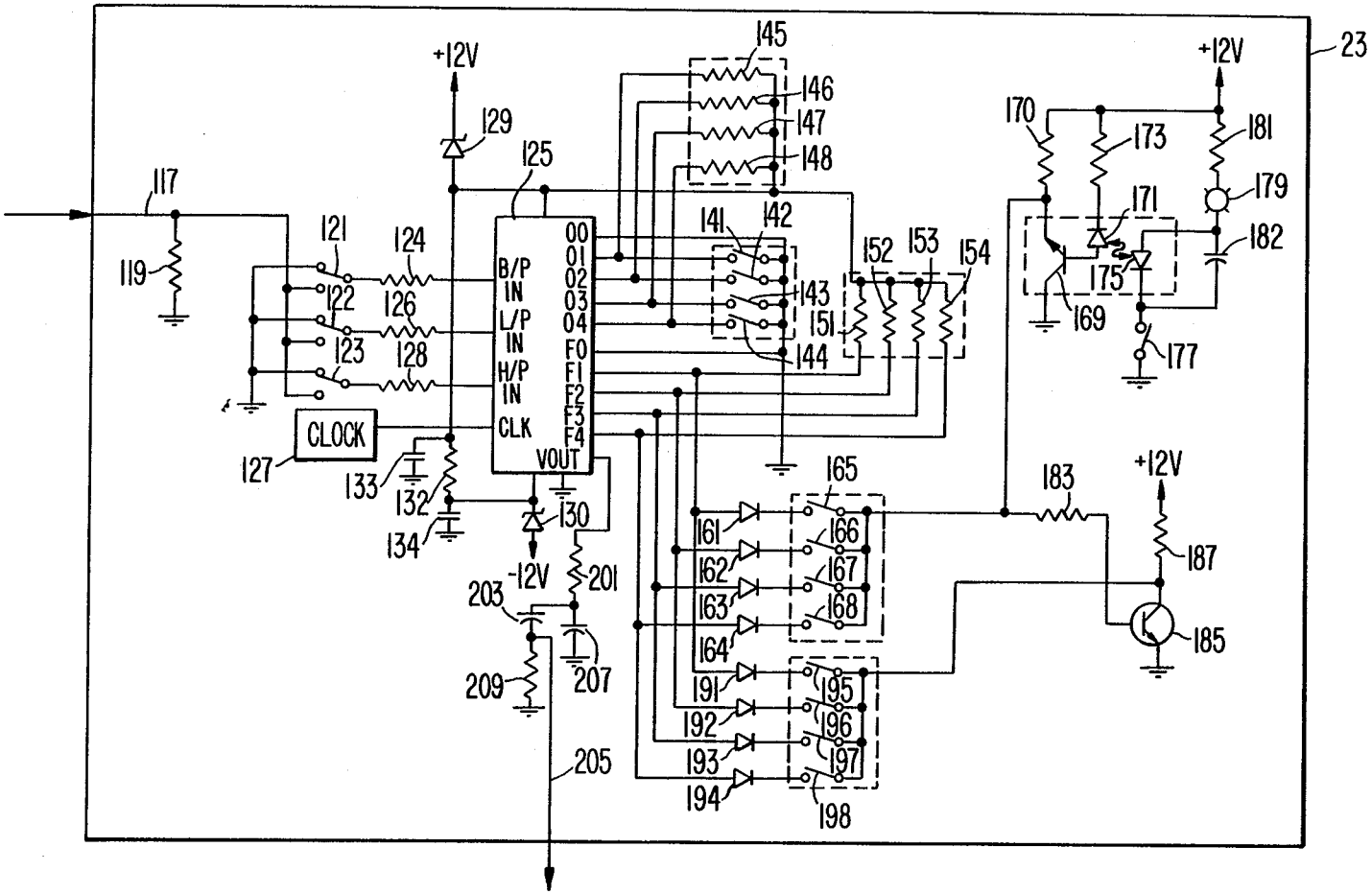
FIG. 3B is a circuit diagram of the programmable filter stage of the infrared detecting system of the invention.

The output signal from the dual channel amplifier 91 is applied through a 1 microfarad capacitor 115 to the input of the programmable filter stage 23. In the programmable filter stage 23, as shown in FIG. 3B, this amplified signal is received on line 119, which is connected to ground through 100 kilohm load resistor 117 and to a series of switches 121 through 123. The switch 121 selectively connects the input signal line 117 or ground to the band pass input of a programmable filter 125 through a 10 kilohm resistor 124. The switch 122 selectively connects either the signal line 117 or ground to the low pass input of the programmable filter 125 through a 10 kilohm resistor 126. The switch 123 will selectively connect the input signal line 117 or ground to the high pass input of the programmable filter 125 through a 10 kilohm resistor 128. Depending on which input line the input filter receives an input signal on, the filter 125 will operate either as a band pass, a low pass or a high pass filter. In the present invention, the switch 123 is positioned to connect the signal line 117 to the high pass input and the switches 121 and 122 connect the corresponding inputs of the programmable filter to ground. The switches 121 and 122 are provided in the circuit for the purposes of future development of the flame detector and are not employed in the functioning of the circuit to detect the presence or absence of a flame as the circuit is presently designed. The programmable filter 125 is available as an off the shelf unit from EG & G Reticon, 345 Potrero Avenue, Sunnyvale, Calif. 94086, which identifies the filter as RU5620A Universal Active Filter.

The programmable filter 125 requires a clock signal and this is provided to the programmable filter 125 by a clock signal source 127. Bias voltages are applied to the programmable filter from plus 12 volt and minus 12 volt sources through zener diodes 129 and 130 so as to apply plus 9.7 and minus 9.7 volts to the plus and minus power input terminals of the programmable filter chip 125. These terminals are interconnected by a 10 kilohm resistor 132 and are connected to ground through 1 microfarad capacitors 133 and 134 respectively. The programmable filter 125 is provided with output pins Q0 through Q4. The output pin Q0 is permanently connected to ground and the output pins Q1 through Q4 can each selectively be connected to ground through switches 141 through 144 respectively. The pins Q1 through Q4 are also connected to the plus 9.7 volt power line through 22 kilohm resistors 145 through 148 respectively. The sharpness of the corner frequency of the high pass filter, referred to as the Q of the filter, can be varied by choosing which combination of the switches 141 through 144 is closed. This selection is made in accordance with the particular burner or burners involved as well as the fuel in the furnace which is burned to generate the flame being detected.

As a general proposition, it is desirable to have the corner frequency as sharp as possible. However, in the programmable filter 125, the sharper the cuto of frequency the higher the gain at the corner frequency and with high Q the filter approaches the characteristis of a narrow band pass filter. The need for a sharp cutoff frequency has to be balanced against excess gain at the corner frequency. This balancing to achieve optimum performance will vary from burner to burner. The use of the switches 141–144 enables the system of the present invention to be optimized to achieve the sharpest cutoff frequency consistent with the gain needed corresponding to the particular furnace that the system is employed with.

The programmable filter 125 has corner frequency controlling pins F0 through F4. In the system of the present invention, the pin F0 is connected to ground. The pins F1 through F4 are connected to the plus 9.7 volts applied to the positive power terminal of the filter through four 22 kilohm resistors 151 through 154 respectively. The pins F1 through F4 are also connected through diodes 161 through 164 and switches 165 through 168 to the emitter of a NPN transistor switch 169, the collector of which is connected to ground. The emitter of the transistor switch 169 is connected through a 10 kilohm resistor 170 to a source of plus 12 volts. The base of the transistor 169 is connected through a photoresponsive diode 171 in series with a 24 kilohm resistor 173 to the source of plus 12 volts. The photo responsive diode 171 is part of an optocoupler and is arranged to receive light from a light emitting diode 175 which is connected to be energized to emit light by being connected in a series circuit with a remotely controlled switch 177, an indicating lamp 179 and a 4.12 kilohm resistor 181 connected in series between the plus 12 volt supply and ground. The diode 175 is shunted by a 0.1 microfarad capacitor 182. The emitter of the transistor 169 is connected through a 10 kilohm resistor 183 to the base of a NPN transistor switch 185, the emitter of which is grounded and the collector of which is connected to the plus 12 volt supply through a 10 kilohm resistor 187. The pins F1 through F4 of the programmable filter 125 are connected severally through diodes 191 through 194 and switches 195 through 198 respectively to the collector of the transistor 185. When the switch 177 is closed, the light emitting diode will be energized to cause the photoresponsive diode 171 to turn on the switch 169. This action will ground the base of the transistor 185 and turn this transistor off. On the other hand, when the switch 177 is open, the transistor switch 169 will be nonconducting causing the transistor switch 185 to conduct. With this arrangement, the different combinations of switches 165 through 168 or 195 or 198 are made effective to control which of the pins F1 through F4 receive a ground voltage or a plus 9.7 volts. The corner frequency of the programmable filter 125 operating in the high pass mode depends upon the clock frequency applied from the clock pulse source 127 and upon which of the pins F0 through F4 are grounded and can be controlled to have different values ranging between 20 and 300 hertz. When the switch 177 is closed, the switches 165 through 168 will control which of the pins F1 through F4 receive ground potential and the switches 195 through 198 will be isolated from the pins F1 through F4 by the back biasing of the diodes 191 through 195. On the other hand, when the switch 177 is open the switches 195 through 198 will control which of the pins F1 through F4 are connected to ground and the switches 165 through 168 will be isolated from the pins F1 through F4 by the back biasing of the diodes 161 through 164. Thus, with a given clock frequency the switches 165 through 168 can select one corner frequency for the programmable filter 125 and the switches 195 through 198 can select a second corner frequency for the programmable filter. These two corner frequencies will be selected to correspond to the different fuels that may be burned within the furnace. Thus, simply by opening or closing the switch 177, the corner frequency can be switched to correspond with one fuel or the other. The indication lamp 179 will provide an indication of which corner frequency is currently selected.

The filtered output signal from the programmable filter 125 is applied to the series circuit of a 4.12 kilohm resistor 201 and a 1 microfarad capacitor 203 to the signal line 205, which connects to the input of the full wave rectifier 25. The junction between the capacitor 203 and the resistor 201 is connected to ground through a 0.1 microfarad capacitor 207. The signal line 205 is connected to ground through a 100 kilohm load resistor 209. The capacitor 203 filters out any DC component in the output signal from the programmable filter 125.

When the flame is present, the signal on the signal line 205 will be an AC signal corresponding to the natural variation in the infrared radiation produced by the burner flame. This AC signal in the full wave rectifier 25, as shown in FIG. 3C, is applied to the plus input of an operational amplifier 211 through a 10 kilohm resistor 213 and to the minus input of an operational amplifier 215 through a 100 kilohm resistor 217. The output of the amplifier 211 is connected back to the inverting input of this amplifier through a 10 kilohm resistor 219 to cause the amplifier 211 to operate with unity gain. The positive input of the amplifier 215 is connected to ground and the output of the amplifier 215 is connected to the inverting input of the amplifier 215 through a 100 kilohm resistor 221, which is shunted by a 680 picofarad capacitor 223. The resistors 217 and 221 are selected to make the amplifier 215 also operate with unity gain. The output of the amplifier 211 is connected to ground through a 24 kilohm resistor 225 and is connected through a rectifying diode 227 to a junction 229 at which the negative half cycles of the AC signal applied on input signal line 205 will be reproduced as positive half cycles. The output of the amplifier 215 is connected through the diode 231 to the junction point 229 to reproduce the positive half cycles of the AC signal at the junction point 229. The junction point 229 is connected through a 150 kilohm load resistor 233 to ground and through a 24 kilohm resistor 235 to one side of a 10 microfarad integrating capacitor 237, the other side of which is connected to ground. As a result a DC voltage will be produced across the capacitor 237 corresponding to the amplitude of the AC signal received by the full wave rectifier on signal line 205 and also corresponding to the amplitude of oscillation of the infrared radiation from the flame above the corner frequency set by the programmable filter 125. When this DC signal level has an amplitude above a value corresponding to the background value produced when no flame is present, it indicates that a flame is present.

The signal voltage produced across the capacitor 237 is applied to the comparitor and meter drive circuit 27, in which it is applied through a 10 kilohm resistor 239 to the positive input of an operational amplifier 241, the output of which is connected through a 196 kilohm resistor 243 to the inverting input of the amplifier 241. The inverting input of amplifier 241 is also connected to ground through a 100 kilohm 245. This circuitry makes the amplifier 241 operate with a gain of about 3. The output of the amplifier 241 is applied through a 1 kilohm resistor 247 to the positive input of a operational amplifier 249. The inverting input of the amplifier 249 receives the output from an operational amplifier 251 through a 10 kilohm resistor 253. The positive input of the amplifier 251 receives a signal voltage level from the tap of a 10 kilohm potentiometer 255 through a 10 kilohm resistor 257. The 10 kilohm potentiometer is connected in the series circuit with a 10 kilohm resistor 259 and a 1 kilohm resistor 261 connected between plus 12 volts and ground. This series circuit will thus act as a voltage divider and serves to provide a voltage level at the positive input of the amplifier 51 corresponding to the voltage level produced at the output of the amplifier 241 when no flame is present. The output of the amplifier 251 is connected through a 10 kilohm resistor 263 to the inverting input of this amplifier so that this amplifier has unity gain. The amplifier 249 has a 100 kilohm resistor connected from its output to its positive input to make the amplifier 249 act as a trigger circuit.

Whenever the output voltage of amplifier 241 rises above the output voltage of the amplifier 251, the output of the amplifier 249 will switch to a high signal voltage level on output line 267 indicating that a flame is present. Whenever the output voltage of the amplifier 241 falls below the output signal voltage of the amplifier 251, the output of amplifier 249 will switch to a low value indicating that no flame is present.

The output from the amplifier 241 is connected through a 4.12 kilohm resistor 271 to the plus side of the voltage meter 275 and the output of the amplifier 251 is applied through a 4.12 kilohm resistor 273 to the minus side of a voltage meter, which provides an indication of the difference between the signal voltage produced across the capacitor 257 and the background signal level produced at the tap of the potentiometer 255. The output of the amplifier 241 is also provided on a separate line 277 to provide an output signal indicating the amplitude of the voltage produced across the capacitor 237 before the background signal level is subtracted. The output of the amplifier 251 is provided on a separate output signal line 279 to provide a signal indication of the background signal level provided at the tap of the potentiometer 255.

With the flame detection system as described above, the circuitry of the flame detector is readily adapted to detect flames produced by different fuels and is readily customized to obtain optimum performance from an indivudual burner. Moreover, when the furnace is designed to burn two different fuels, with each fuel requiring a different amplifier gain and a different corner frequency in the filter of the system to obtain optimum performance for reliable flame detection, the changing of the parameters to correspond with each different fuel is greatly facilitated. The above description is of a preferred embodiment of the invention and modification may be made thereto without departing from the spirit and scope of the invention, which is defined in the appended claims.

What is claimed is:

1. A flame detection system comprising an infrared photodetector positioned to receive infrared radiation from a flame and operable to generate an output signal corresponding to the intensity of the received infrared radiation, amplifying means to amplify the AC variation in the output signal from said photodetector, programmable high pass filter means connected to the output of said amplifying means to pass AC signal components in the output signal of said amplifying means above a corner frequency, control means to vary said corner frequency between selected values, means to rectify the output signal of said high pass filter means to produce a DC signal level corresponding to the amplitude of the AC output signal of said filter means, comparison means to compare the DC output signal of said rectifier with a reference value and produce a first output signal value when the output signal of said rectifier is above said reference level indicating the presence of a flame and to produce a second output signal value when the output of said rectifier is below said reference value indicating the absence of a flame.

2. A flame detector system as recited in claim 1, wherein said control means comprises at least one switch means having first and second states, said control means setting said corner frequency at a first value when said switch means is in a first state and setting said corner frequency at a second value when said switch means is in a second state.

3. A flame detection system as recited in claim 2, wherein said first value of corner frequency is selected to optimize the reliable indication by the output signal of said comparitor means of the presence or absence of flame when said flame is generated by the combustion of a first fuel and wherein said second value of said corner frequency is selected to optimize the reliable indication by the output signal of said comparison means of the presence or absence of a flame when the flame is generated by the combustion of a second fuel different than said first fuel.

4. A flame detection system as recited in claim 2, wherein said switch means comprises a switch which is closed in said first state and open in said second state.

5. A flame detection system as recited in claim 1, wherein said control means comprises a plurality of switches, each having an open and a closed state, said corner frequency depending upon the combination of the states of said plurality of switches.

6. A flame detection system as recited in claim 1, wherein said control means comprises a first set of switches, each having an open and a closed state, a second set of switches each having an open and a closed state, and binary means to select said first set of switches or said second set of swtiches, said control means being operable to select the corner frequency of said filter means in accordance with the combination of open and closed states of the switches of the set selected by said binary means.

7. A control system as recited in claim 1, wherein said amplifying means includes a first channel of amplification and a second channel of amplification, means to individually control the gains in each of said amplification channels and means to select one of said first and second amplification channels to amplify the AC output signal of said photodetector and apply the amplified signal to said filter means.

8. A flame detection system as recited in claim 1, further comprises a thermistor connected in circuit with said photodetctor and said amplification means to compensate the output signal of said photodetector for variations in temperature.

* * * * *